US005495687A

United States Patent [19]

Waiser

[11] Patent Number: 5,495,687

[45] Date of Patent: Mar. 5, 1996

[54] FIREARM MAGAZINE

[76] Inventor: Shimon Waiser, 1227 E. 84 St., Brooklyn, N.Y. 11236

[21] Appl. No.: 389,766

[22] Filed: Feb. 16, 1995

[51] Int. Cl.[6] ..... F41A 9/70

[52] U.S. Cl. ..... 42/50; 89/33.1

[58] Field of Search ..... 42/50, 7, 18, 22; 89/33.1, 34

[56] References Cited

U.S. PATENT DOCUMENTS

| | | | |
|---|---|---|---|
| 2,441,735 | 5/1948 | Warner | 42/50 |
| 3,158,947 | 12/1964 | Menneking et al. | 42/50 |
| 5,113,605 | 5/1992 | Kim | 42/50 |

FOREIGN PATENT DOCUMENTS

| | | | |
|---|---|---|---|
| 637124 | 4/1928 | France | 42/7 |
| 309107 | 12/1919 | Germany | 42/50 |
| 382946 | 10/1923 | Germany | 42/50 |
| 712084 | 10/1941 | Germany | 42/50 |

*Primary Examiner*—Stephen M. Johnson

[57] ABSTRACT

A firearm magazine has a cartridge pushing means including a follower, an auxiliary follower, a relatively short main spring, and a relatively short auxiliary spring; as opposed to the conventional firearm magazine having one follower and one relatively long spring. If the invented firearm magazine and the conventional firearm magazine have the same size and both are fully loaded, all the springs—short ones and long one—are compressed to the same length, and it is obvious that the spring tension for the short spring is much less than the same for the long one, and accordingly the invented firearm magazine can stay fully loaded much longer than the conventional one, without losing restoring force of the springs.

15 Claims, 5 Drawing Sheets

FIREARM MAGAZINE

BACKGROUND OF THE INVENTION

This invention relates to firearms and it has reference more particularly to improvement in firearm magazines.

Most automatic and semiautomatic firearms use magazines for storing cartridges and feeding weapons. The capacity of the magazines ranges from 3–4 to dozens of cartridges. The conventional magazine usually has a magazine body or tube, a follower, a spring, a floor plate and a floor plate catch. An uncompressed magazine spring is usually long, and it becomes very short in a compressed position when the magazine is fully loaded. If the magazine is fully loaded, the compressed magazine spring loses its restoring force in several months, and after this period the magazine spring cannot deliver all the loaded cartridges to the weapon during shooting. To avoid this problem experts recommend not to have the magazine fully loaded for long periods of time, or to load magazines with approximately 10–20% fewer cartridges than their rated capacity. Accordingly, the weapons lose a part of their cartridge capacity.

These and other difficulties experienced with the prior art devices have been obviated in a novel manner by the present invention.

SUMMARY OF THE INVENTION

Accordingly, it is an object of the present invention to provide a firearm magazine that avoids the disadvantages of the prior art and to make weapon magazines which can be fully loaded for long periods of time without losing the restoring force of their springs.

Another object of the invention is to make magazine springs much shorter, so that in the compressed position spring tension is much less than the tension of the conventional long spring in the same compressed position.

It is a further object of the present invention to provide a firearm magazine with a capability to hold more cartridges with the same size of the magazine tube.

Other objects and advantages of the present invention will be apparent from the accompanying description when considered in conjunction with the accompanying drawings.

DESCRIPTION OF A PREFERRED EMBODIMENT

Figure 1:
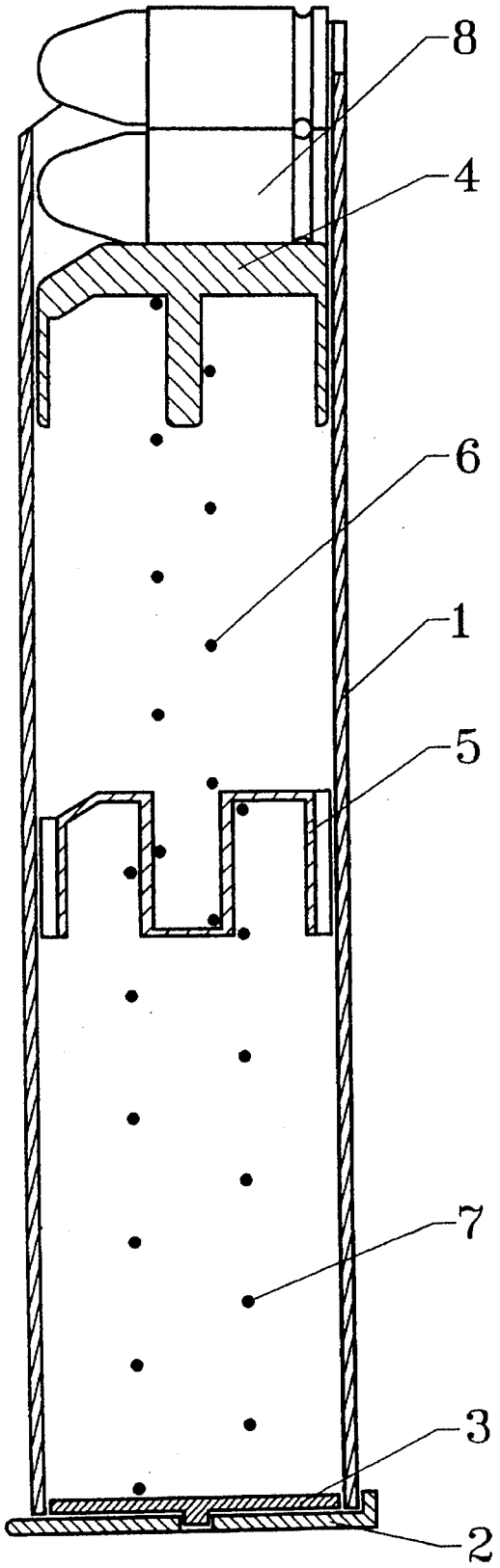
FIG. 1 is a vertical central longitudinal section of a partially loaded invented firearm magazine, showing most of the parts in section, but some parts in elevation.

A firearm magazine in accordance with the present invention comprises a magazine tube 1, a magazine floor plate 2, a magazine floor plate catch 3, a main magazine follower 4, a main magazine spring 6, an auxiliary magazine follower 5, and an auxiliary magazine spring 7.

Figure 2:
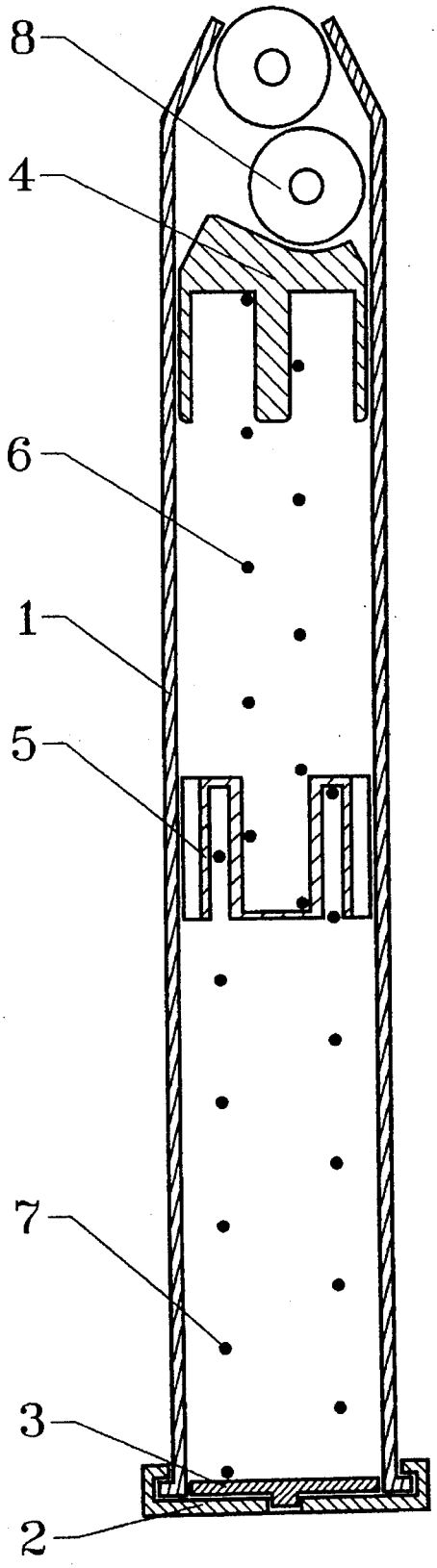
FIG.2 is a rear end view of the firearm magazine corresponding to that of FIG. 1, showing most of the parts in section, but some parts in elevation.

As can be seen in FIG. 1 and FIG.2 where the firearm magazine is shown loaded with two cartridges 8, the main magazine follower 4 is located in the upper part of the magazine tube 1, the auxiliary magazine follower 5 is disposed in the middle part of magazine tube 1, the main magazine spring 6 is located between the main magazine follower 4 and the auxiliary magazine follower 5, and the auxiliary magazine spring 7 is located between the auxiliary magazine follower 5 and the magazine floor plate catch 3. Both springs 6 and 7 are just slightly compressed and can stay in this state very long without losing their restoring forces.

Figure 3:
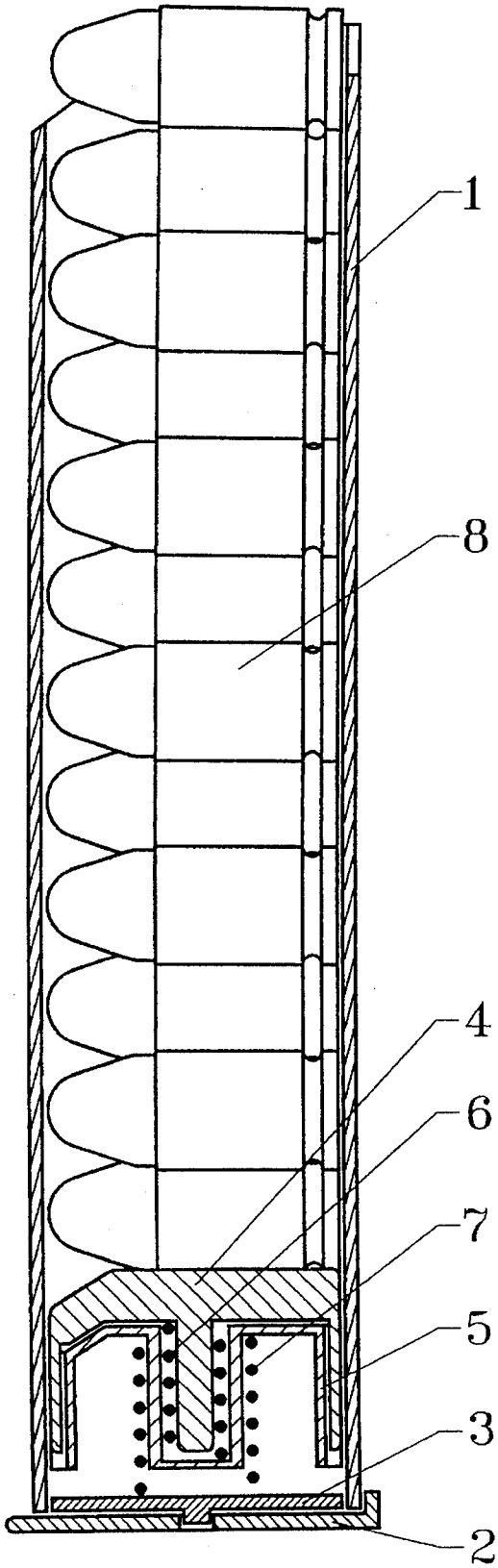
FIG.3 is a similar view to that of FIG. 1 when the invented firearm magazine is fully loaded.
Figure 4:
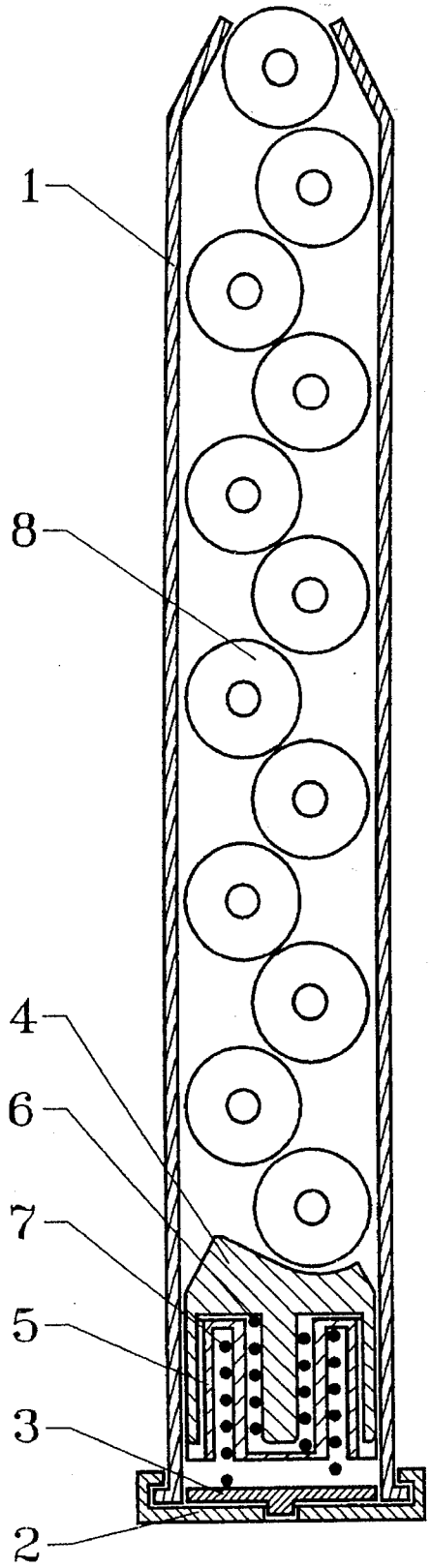
FIG.4 is a similar view to that of FIG.2 when the invented firearm magazine is fully loaded.
Figure 5:
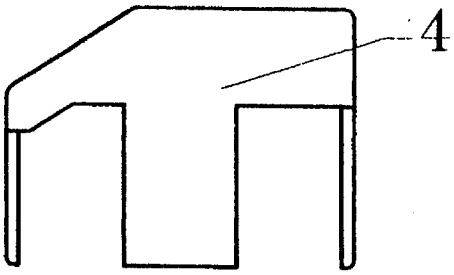
FIG.5 is a side view of the main follower.
Figure 6:
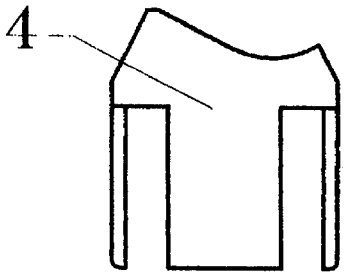
FIG.6 is a rear end view of the main follower.

In FIG.3 and FIG.4 the same firearm magazine is shown fully loaded with 12 cartridges. In this state the main magazine follower 4, the auxiliary magazine follower 5, and both springs 6 and 7 are located in the bottom part of the magazine tube 1. Springs 6 and 7 are much more compressed than in the previous state shown in FIG. 1 and FIG.2. However springs 6 and 7 still are not fully compressed and they can remain in this state for prolonged periods without losing their restoring force.

Now let's look at the conventional firearm magazine shown in FIGS. 11, 12, 13 and 14. This conventional firearm magazine has the magazine tube I that is the same magazine tube I of FIGS. 1, 2, 3 and 4. The magazine floor plate 2, the magazine floor plate catch 3 and the magazine follower 4 are the same as the corresponding number parts of the firearm magazine shown in FIGS. 1, 2, 3 and 4. However, the magazine of FIGS. 11, 12, 13 and 14 is not provided with the auxiliary magazine follower 5, and the auxiliary magazine spring 7, and the main magazine spring **6*a* is approximately twice as long as each of the springs 6 and 7 of FIGS. 1, 2, 3 and 4**.

Figure 11:
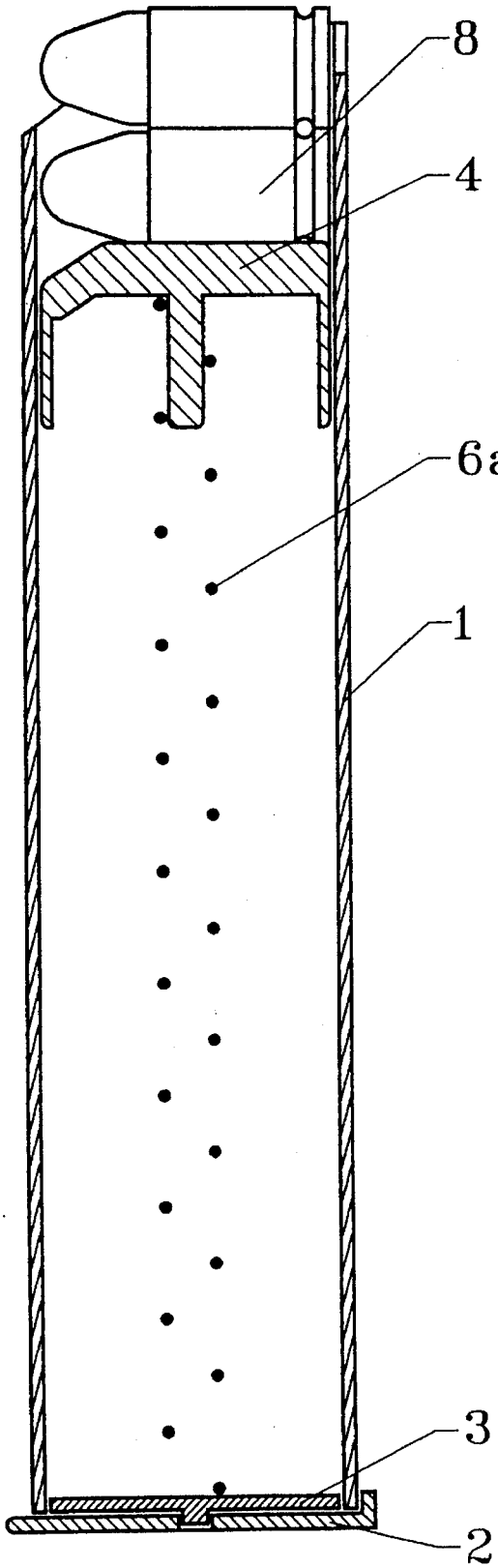
FIG.11 is a vertical central longitudinal section of a partially loaded conventional firearm magazine, showing most of the parts in section, but some parts in elevation.
Figure 12:
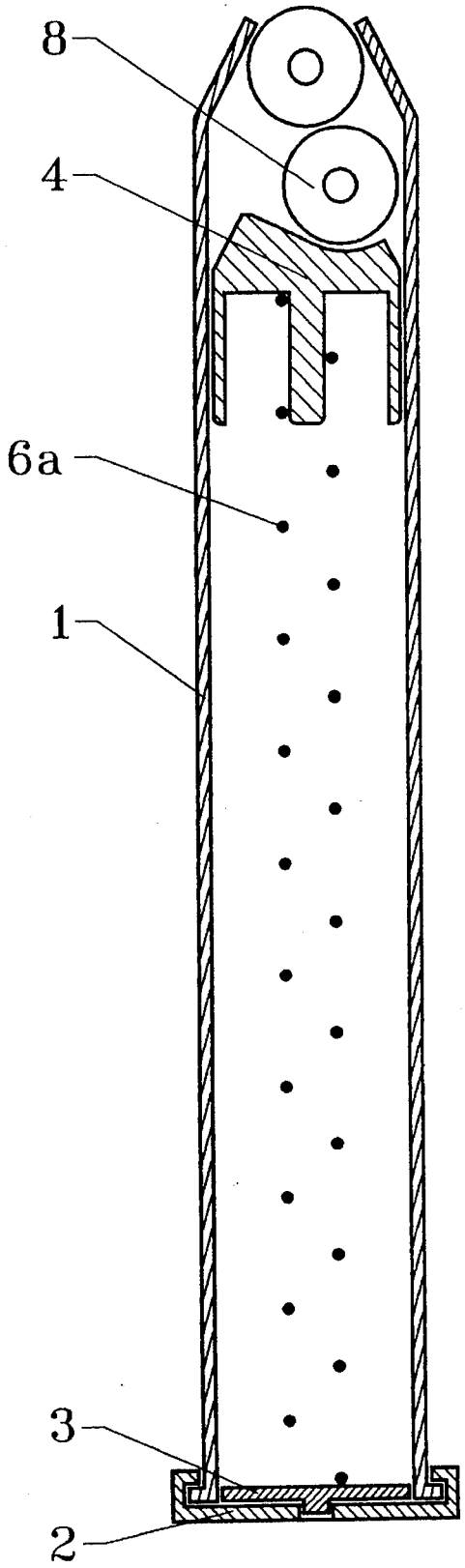
FIG. 12 is a rear end view of the firearm magazine corresponding to that of FIG. 11, showing most of the parts in section, but some parts in elevation.

As can be seen in FIG.11 and FIG. 12 where the conventional firearm magazine is shown loaded with two cartridges similar to FIG. 1 and FIG.2, the main magazine spring **6*a* is slightly compressed, similar to compression of the springs 6 and 7 in FIGS. 1 and 2**, and it can also stay in this condition for prolonged periods without losing its restoring force.

Figure 7:
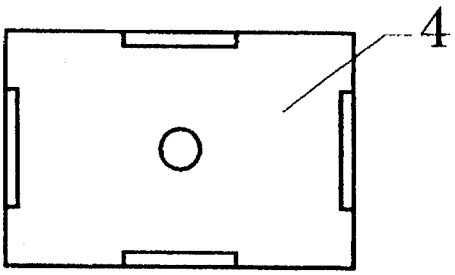
FIG.7 is an under side view of the main follower.
Figure 10:
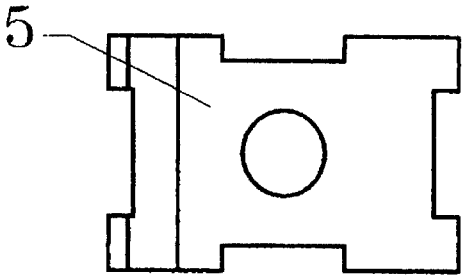
FIG. 10 is a top plan view of the auxiliary follower.
Figure 8:
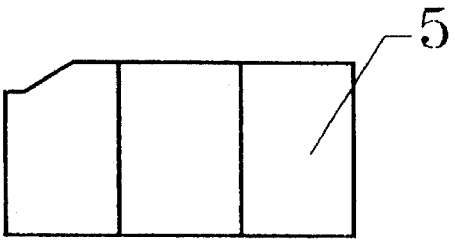
FIG.8 is a side view of the auxiliary follower.
Figure 9:
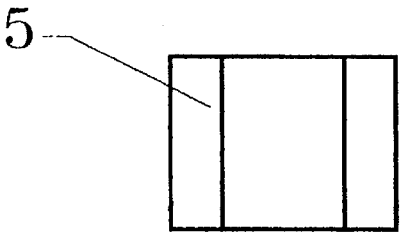
FIG.9 is a rear end view of the auxiliary follower.
Figure 13:
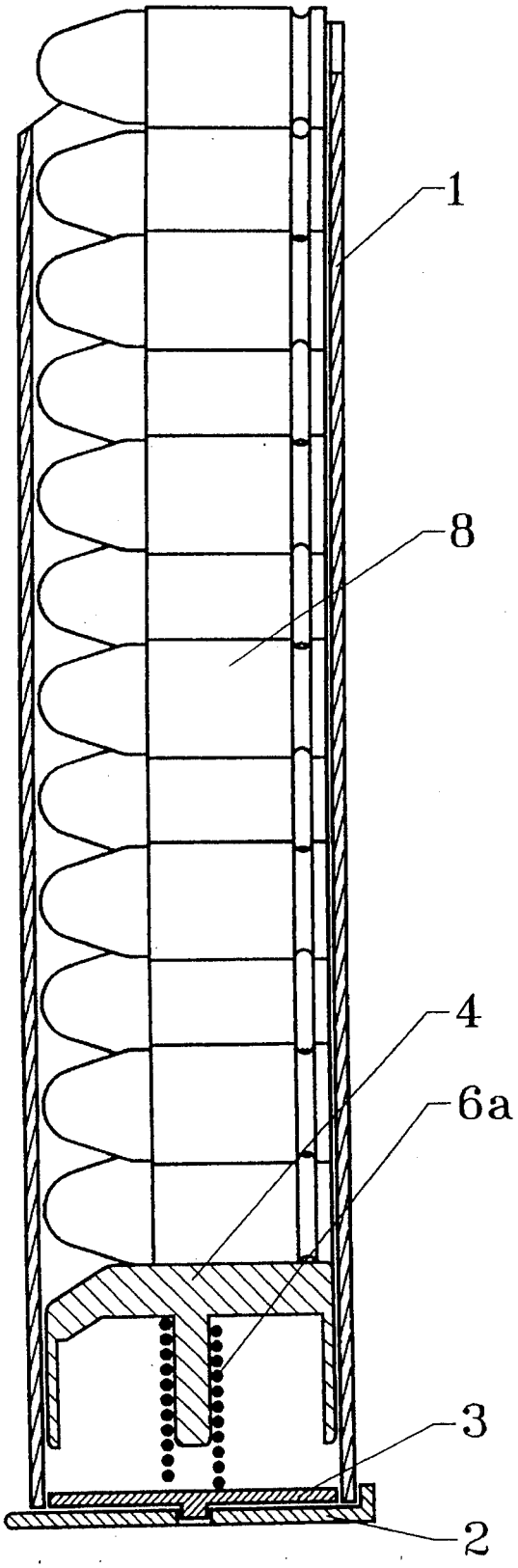
FIG. 13 is a similar view to that of FIG. 11 when the conventional firearm magazine is fully loaded.
Figure 14:
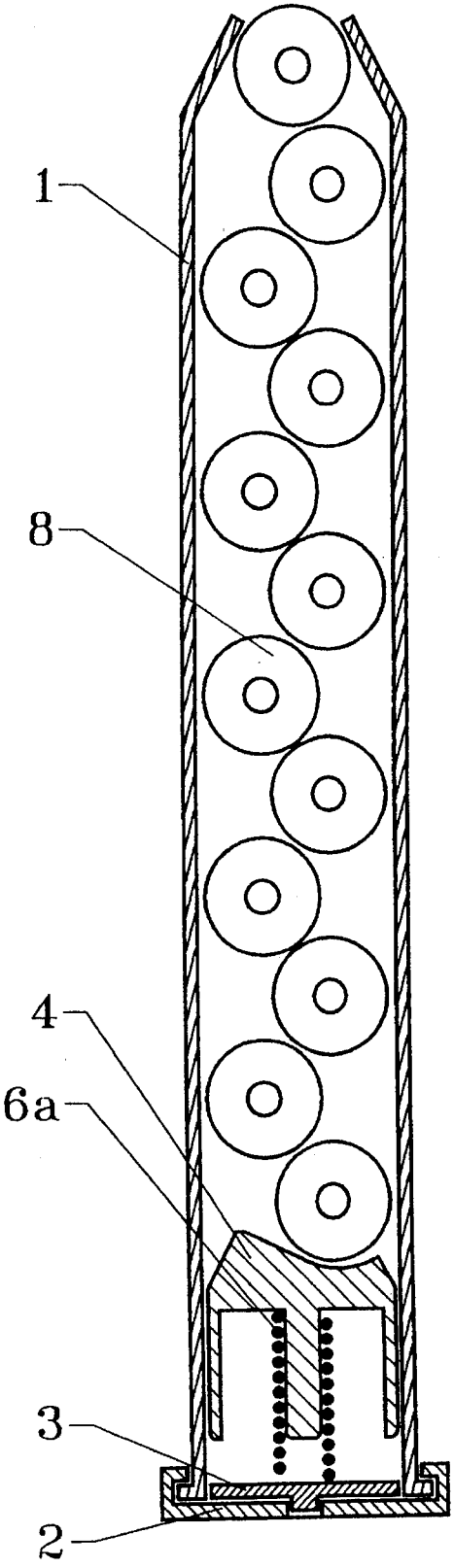
FIG.14 is a similar view to that of FIG. 12 when the conventional firearm magazine is fully loaded.

In FIG.13 and FIG. 14 the same conventional firearm magazine is shown fully loaded with 12 cartridges. The main magazine spring **6*a* is compressed almost twice as much as either of the springs 6 and 7 of FIG.3 and FIG.7 is compressed. This occurs because the distances between the bottom surface of the main follower 4 and the top surface of the floor plate catch 3 are the same in FIGS. 3, 4, 13 and 14, but the length of the spring 6*a* is twice the length of the spring 6. So the spring 6*a* in the fully loaded conventional firearm magazine has compression approximately twice that of the spring 6 in the invented magazine, and, accordingly, in the conventional firearm magazine the main spring 6a will lose its restoring force much faster than the springs 6 and 7** will lose their restoring force in the invented firearm magazine.

It is obvious that the main magazine follower 4 and the auxiliary magazine follower 5 shown in FIGS. 1, 2, 3 and 4 can be shortened slightly, and, therefore, they will be located closer to the magazine floor plate catch 3 when the magazine is fully loaded, thereby permitting loading the magazine with 1-2 more cartridges. However, in that condition the springs 6 and 7 will be much more compressed and the advantage of the design shown in FIGS. 1, 2, 3 and 4 can disappear, but on other hand the same size magazine will have larger cartridge capacity.

It is to be understood that the invention is not limited to the details shown inasmuch as any modifications and structural changes are possible without departing in any way from the spirit of the present invention.

What is claimed is:

1. A firearm magazine comprising a tube having lateral walls, a cartridge pushing means including at least one main spring, at least one main follower being under the action of said main spring having an upper and a bottom ends, at least one auxiliary spring and at least one auxiliary follower being under the action of said auxiliary spring having an upper and a bottom ends, said auxiliary follower having an upper surface and a bottom surface, said upper surface of the auxiliary follower having at least one recess in which the bottom end of the main spring is located when the magazine is empty and in which almost the entire main spring is located when the magazine is fully loaded with cartridges, said bottom surface of the auxiliary follower having at least one recess in which the upper end of the auxiliary spring is located when the magazine is empty and in which almost the entire auxiliary spring is located when the magazine is fully loaded.

2. A firearm magazine as claimed in claim 1, wherein said bottom end of the main spring and said upper end of the auxiliary spring are located in a middle portion of the tube when the firearm magazine is not loaded.

3. A firearm magazine as claimed in claim 1, wherein said main and said auxiliary spring has a length approximately one half of a length of the tube when the magazine is empty.

4. A firearm magazine as claimed in claim 1, wherein said main follower has prolongated lateral surfaces serving as guides during movement of said main follower relative to said tube lateral walls when magazine is being loaded or unloaded.

5. A firearm magazine as claimed in claim 1, wherein said auxiliary follower has prolongated lateral surfaces serving as guides during movement of said auxiliary follower relative to said tube lateral walls when magazine is being loaded or unloaded.

6. A firearm magazine as claimed in claim 1, wherein a bigger part of the main spring is located inside of said auxiliary spring when the magazine is fully loaded and the main spring looks as an extension of the auxiliary spring when the magazine is empty.

7. A firearm magazine as claimed in claim 1, wherein said main spring and said auxiliary spring are wire compression springs.

8. A firearm magazine comprising a tube having lateral walls, a cartridge pushing means including at least one main spring, at least one main follower being under the action of said main spring having an upper and a bottom ends, at least one auxiliary spring and at least one auxiliary follower being under the action of said auxiliary spring having an upper and a bottom ends, said auxiliary follower having an upper surface and a bottom surface, said upper surface of the auxiliary follower having at least one recess in which the bottom end of the main spring is located when the magazine is empty and in which a bigger part of the main spring is located when the magazine is fully loaded with cartridges, said bottom surface of the auxiliary follower having at least one recess in which the upper end of the auxiliary spring is located when the magazine is empty and in which a bigger part of the auxiliary spring is located when the magazine is fully loaded.

9. A firearm magazine as claimed in claim 8, wherein said recess in the upper surface of the auxiliary follower contains at least a half of the main spring when the magazine is fully loaded and wherein said recess in the bottom surface of the auxiliary follower contains at least a half of the auxiliary spring when the magazine is fully loaded.

10. A firearm magazine as claimed in claim 8, wherein said bottom end of the main spring and said upper end of the auxiliary spring are located in a middle portion of the tube when the firearm magazine is not loaded.

11. A firearm magazine as claimed in claim 8, wherein said main and said auxiliary spring has a length approximately one half of a length of the tube when the magazine is empty.

12. A firearm magazine as claimed in claim 8, wherein said main follower has prolongated lateral surfaces serving as guides during movement of said main follower relative to said tube lateral walls when magazine is being loaded or unloaded.

13. A firearm magazine as claimed in claim 8, wherein said auxiliary follower has prolongated lateral surfaces serving as guides during movement of said auxiliary follower relative to said tube lateral walls when magazine is being loaded or unloaded.

14. A firearm magazine as claimed in claim 8, wherein a bigger part of the main spring is located inside of said auxiliary spring when the magazine is fully loaded and the main spring looks as an extension of the auxiliary spring when the magazine is empty.

15. A firearm magazine as claimed in claim 8, wherein said main spring and said auxiliary spring are wire compression springs.

* * * * *